United States Patent [19]

Nishikawa et al.

[11] Patent Number: 4,525,706

[45] Date of Patent: Jun. 25, 1985

[54] MISFEED MONITORING APPARATUS FOR TRANSFER PRESS

[75] Inventors: Yoshinori Nishikawa, Kanazawa; Iwashige Takahashi, Komatsu, Japan

[73] Assignee: Kabushiki Kaisha Komatsu Seisakusho, Tokyo, Japan

[21] Appl. No.: 390,506

[22] Filed: Jun. 21, 1982

[51] Int. Cl.[3] ..... G08B 21/00

[52] U.S. Cl. ..... 340/679; 100/99; 340/540; 340/691

[58] Field of Search ..... 340/679, 540, 691; 100/99

[56] References Cited

U.S. PATENT DOCUMENTS

| | | | |
|---|---|---|---|
| 3,626,367 | 12/1971 | Howard et al. | 340/540 |
| 3,665,399 | 5/1972 | Zehr et al. | 340/679 |
| 4,446,787 | 5/1984 | Nishikawa et al. | 100/99 |

*Primary Examiner*—Glen R. Swann III

*Attorney, Agent, or Firm*—Spensley Horn Jubas & Lubitz

[57] ABSTRACT

A misfeed monitoring apparatus for transfer press of a type in which feeder stroke is changeable has a display system for indicating when misfeeding of a workpiece takes place.

This display system displays the number assigned to each work station being in use in the operation order and causes a display corresponding to a work station to flicker if misfeeding takes place at this work station.

Such display is realized by providing the monitoring apparatus with a memory for storing data on the operation state of the work stations and a circuit for causing the display to flicker in response to the output of the memory.

3 Claims, 12 Drawing Figures

MISFEED MONITORING APPARATUS FOR TRANSFER PRESS

BACKGROUND OF THE INVENTION

The present invention relates to a misfeed monitoring apparatus in transfer press.

A conventional transfer press is usually designed to have a fixed number of work stations, a fixed distance of feeder stroke and a fixed transversal distance between a pair of feeder bars (i.e. fixed feeder width). FIG. 1 shows a part of a display in a misfeed monitoring apparatus for the conventional transfer press as described above. Specifically, the misfeed monitoring apparatus includes a display panel on which a plurality of display lamps $L_{p1}$ to $L_{p8}$ are arranged in a line corresponding to eight work stations. As a press machine (not shown) starts to operate, the lamps $L_{p1}$ to $L_{p8}$ are lit. If there occurs a misfeed with the press for any reason, the misfeed is represented by intermittent lighting of the lamp corresponding to the work station where it takes place.

In recent years a new technique in press operation has been developed which is practiced in such a manner that a distance of feed stroke and the number of work stations in operation may be changed within a single transfer press. In this type of transfer press, only the work stations in operation should be displayed but no display is required for other work stations where press operation is not conducted.

However, due to the arrangement in the prior art that all the work stations operate and are so displayed, it fails to meet the requirement for a transfer press in which the number of work stations in operation changes.

SUMMARY OF THE INVENTION

Thus, the present invention is intended to obviate the drawback with the conventional incorrect feed monitoring apparatus as described above.

It is an object of the present invention to provide a misfeed monitoring apparatus for a transfer press in which only the work stations currently in operation are displayed and in the event of an occurrence of an incorrect feed, lamps for the corresponding work stations are caused to be intermittently lit.

Another object of the invention is to provide a misfeed monitoring apparatus for a transfer press in which number of work stations can be changed as required.

Still another object of the invention is to provide a misfeed monitoring apparatus in transfer press in which the order of press operations at each work station can be displayed in the form of numerals, thus ensuring detection of abnormality with feeder bars in transferring workpiece.

Now the present invention will be described in more detail with reference to the accompanying drawings which illustrate a preferred embodiment of the present invention.

BRIEF DESCRIPTION OF THE DRAWINGS

In the accompanying drawings,

FIG. 3(*b*) is a front view illustrating that an incorrect feed of the sheet material takes place;

DETAILED DESCRIPTION OF THE DRAWINGS

Figure 1:
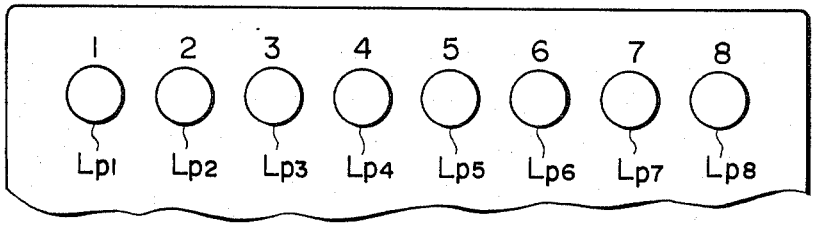
FIG.1 PRIOR ART
FIG. 1 is a partial view illustrating a typical display in a conventional misfeed monitoring apparatus.
Figure 2:
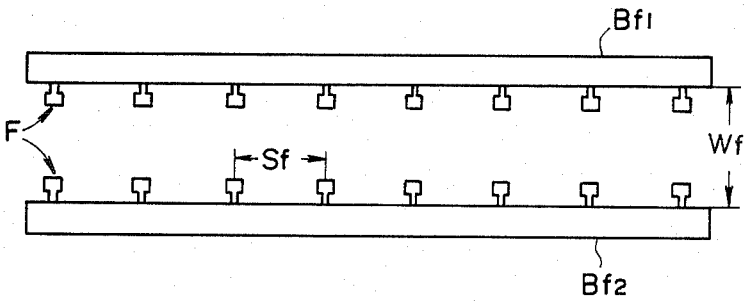
FIG. 2 is a plan view illustrating a typical arrangement of a pair of oppositely located feeder bars.

Referring to FIG. 2 which shows pairs of oppositely located feeder bars for a transfer press to which a misfeed monitoring apparatus in accordance with the present invention is applied, the feeder bars $B_{f1}$ and $B_{f2}$ include a number of fingers F which are oppositely located on these feeder bars corresponding to the work stations. As is apparent from FIG. 2, the respective fingers F are spaced by a distance equal to the feeder stroke $S_f$. When there occurs a necessity for changing the feeder stroke for a press, the fingers F are caused to be spaced by a different distance. As a result, the number of work stations changes. Further, with the change of workpiece dimensions, a transversal distance between the feeder bar $B_{f1}$ and the feeder bar $B_{f2}$, that is, a feeder width $W_f$ is caused to change.

Figure 3A:
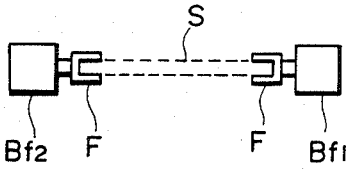
FIG. 3(*a*) is a front view illustrating that the feeder bars transfer a sheet material in a correct manner.
Figure 3B:
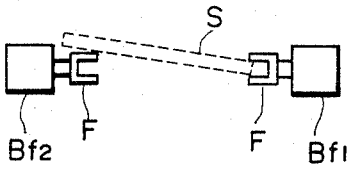

FIG. 3(*a*) shows that a sheet material (workpiece) S is correctly transferred by means of the fingers F on the feeder bars $B_{f1}$ and $B_{f2}$, whereas FIG. 3(*b*) shows that the fingers F fail to grip the sheet material S, that is, incorrect gripping is effected. In the latter case a misfeed detecting signal is issued from the corresponding work station.

Figure 4:
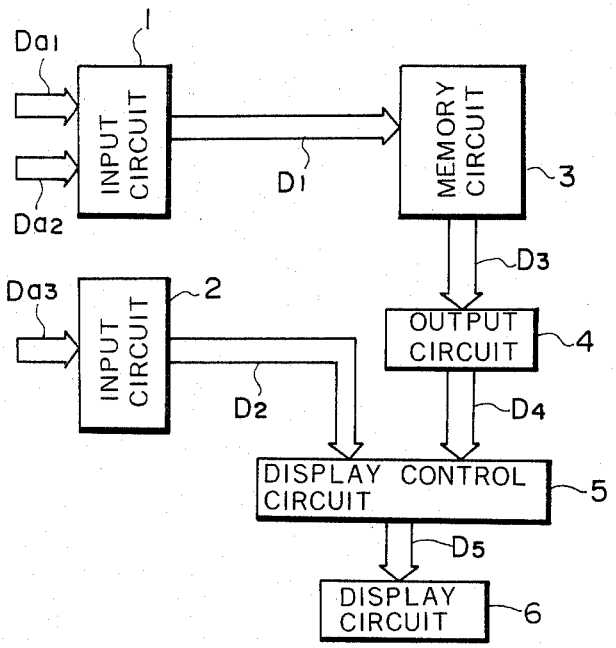
FIG. 4 is a block diagram schematically illustrating a misfeed monitoring apparatus in accordance with an embodiment of the present invention.

FIG. 4 is a block diagram which schematically illustrates a misfeed monitoring apparatus in accordance with an embodiment of the present invention.

Referring to FIG. 4, a feeder stroke signal $D_{a1}$ corresponding to a predetermined feeder stroke and a feeder width signal $D_{a2}$ corresponding to a predetermined feeder width are determined with the aid of a feeder stroke determining device (not shown) and a feeder width determining device (not shown) and then these signals $D_{a1}$ and $D_{a2}$ enter a memory circuit 3 as an address signal $D_1$ by way of an input circuit 1. The memory circuit 3 outputs a display signal $D_3$ representing a selection of a work station in the press, a feeder stroke distance and a feeder width ih response to the entered address signal $D_1$ to an output circuit 4. The output circuit 4 generates a lighting signal $D_4$ on the basis of the entered signal $D_3$ so that the lighting signal $D_4$ enters a display control circuit 5.

When misfeeding takes place, a misfeed signal $D_{a3}$ enters an input circuit 2 and then it enters the display control circuit 5 as a signal $D_2$.

The display control circuit 5 generates a display circuit drive signal $D_5$ in response to the signals $D_2$ and $D_4$ and then the display circuit drive signal $D_5$ enters a display circuit 6. The display circuit 6 serves for displaying the operation of the press machine on the basis of the entered signal $D_5$.

Figure 5:
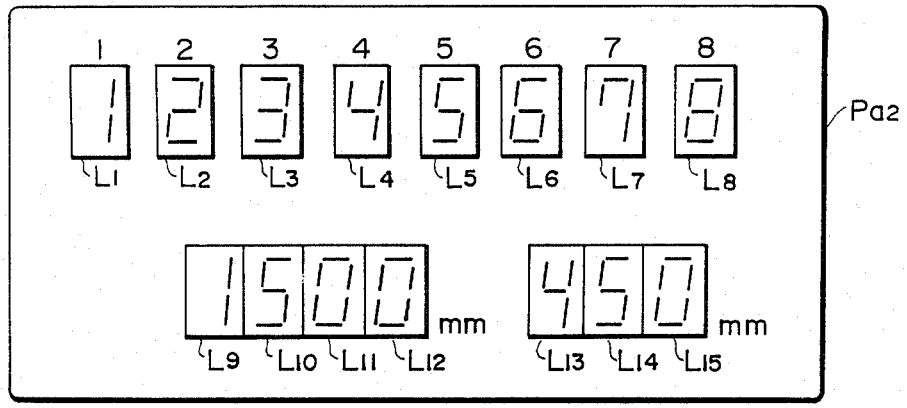
FIG. 5 is a front view of an example of a display panel for the misfeed monitoring apparatus of the invention.

Referring to FIG. 5, the display circuit 6 includes a display panel $P_{a2}$ on which seven-segment type numeral display devices (hereinafter referred to merely as display device) $L_1$ to $L_8$ indicating the work station, display devices $L_9$ to $L_{12}$ indicating the feeder widths and display devices $L_{13}$ to $L_{15}$ indicating the feeder strokes are located.

The display panel $P_{a2}$ is operated in such a manner that a display device corresponding to an operating work station is identified by a decimal numeral which represents the working order of the work station. With respect to the feeder width, the dimension is identified by decimal numerals in millimeter on the display devices $L_9$ to $L_{12}$, whereas with respect to the feeder stroke the dimension is identified by the display devices $L_{13}$ to $L_{15}$ in the same manner.

Table 1 shows an example of a relation between the length of a feeder stroke and the number of work stations.

TABLE 1

| feeder stroke | number of work station |
|---|---|
| 900 mm | 4 |
| 750 mm | 5 |
| 600 mm | 6 |
| 450 mm | 8 |

In case that the feeder stroke is for instance 450 mm the display devices $L_1$ to $L_8$ are activated in conformance with the order of the decimal numerals 1 to 8 as illustrated in FIG. 5. At the same time, the display devices $L_{13}$ to $L_{15}$ are activated to display the decimal numerals 4, 5 and 0 in the order as illustrated in the drawing. In the illustrated case the feeder width is determined constant, that is, 1,500 mm during the press operation.

Figure 6:
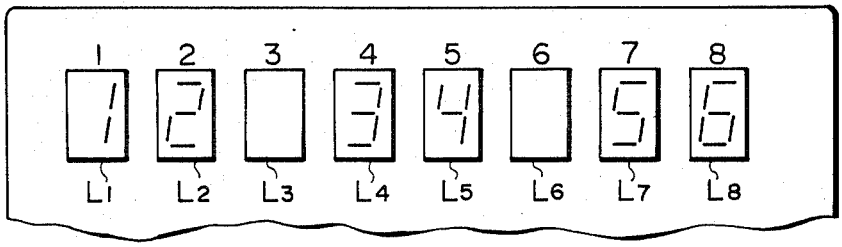
FIGS. 6, 7 and 8 are a partial front view of the display panels which have a different numeral order corresponding to a given feeder stroke.

In case that the feeder stroke is dimensioned, for instance, 600 mm, the display devices $L_1$, $L_2$, $L_4$, $L_5$, $L_7$ and $L_8$ are activated to display the numerals 1 to 6, respectively but the display devices $L_3$ and $L_6$ are not activated, as illustrated in FIG. 6. The activation of the display devices in the above described manner represents the operating order of the respective work stations which are currently in operation. The distance equivalent to the feeder stroke is represented by the display devices $L_{13}$ to $L_{15}$ (not shown).

Figure 7:
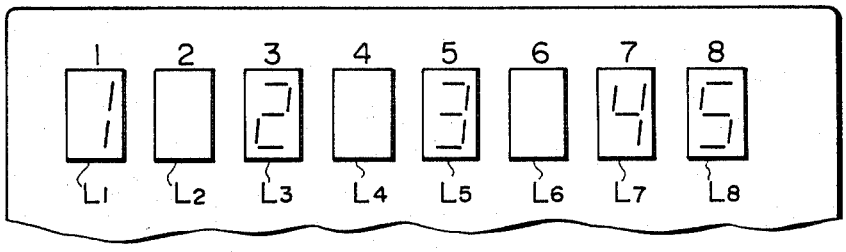
Figure 8:
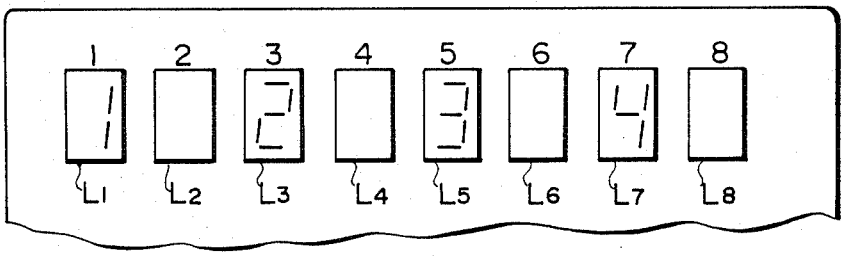

In case that the feeder stroke is dimensioned, for instance, 750 mm, the display devices $L_1$, $L_3$, $L_5$, $L_7$ and $L_8$ are activated to display the numerals 1 to 5 respectively, but the display devices $L_2$, $L_4$ and $L_6$ are not activated, as illustrated in FIG. 7. The distance equivalent to the feeder stroke is represented by the display devices $L_{13}$ to $L_{15}$ (not shown).

In case that the feeder stroke is dimensioned, for instance, 900 mm, the display devices $L_1$, $L_3$, $L_5$ and $L_7$ are activated to display the numerals 1 to 4, but the display devices $L_2$, $L_4$, $L_6$ and $L_8$ are not activated. The distance equivalent to the feeder stroke is represented by the display devices $L_{13}$ to $L_{15}$ (not shown).

When misfeeding takes place, for instance, at the seventh work station where the fourth press operation is to be conducted with the feeder stroke of 750 mm, the display device $L_7$ is caused to be intermittently lit so as to intentionally display the numeral 4. Thus, an occurance of an abnormality with the fourth work station can be identified.

Figure 9:
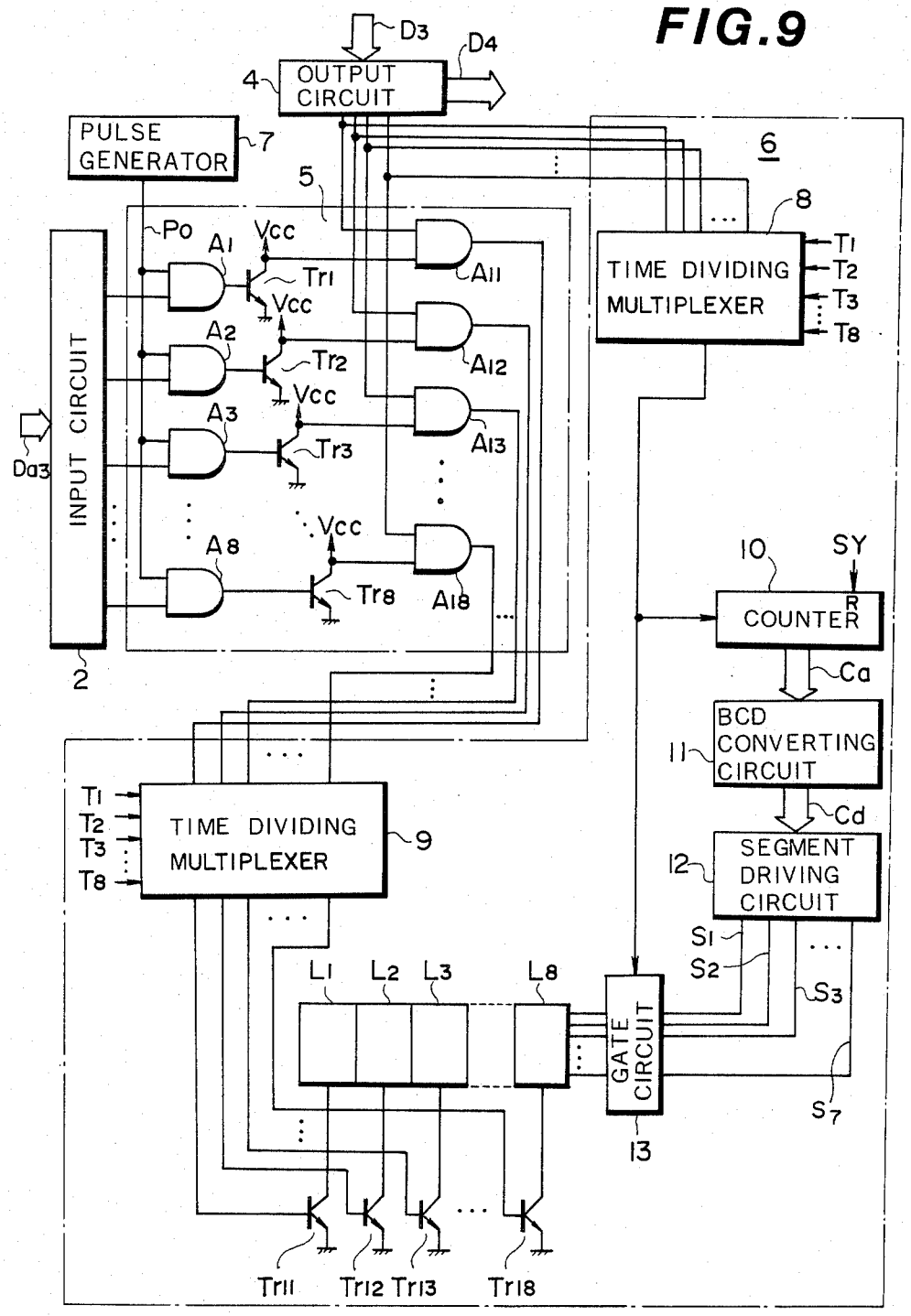
FIG. 9 is a block diagram of both a display control circuit and a display circuit for the misfeed monitoring apparatus in accordance with an embodiment of the invention.

FIG. 9 shows an example of both the display control circuit 5 and the display circuit 6, particularly illustrating a part thereof relative to the display devices $L_1$ to $L_8$. The exemplified circuit will be described in greater detail below particularly with respect to the case where the feeder stroke is dimensioned at 600 mm.

It is assumed that no misfeeding takes place and both the feeder bars $B_{f1}$ and $B_{f2}$ are normally operated. Since no misfeed detecting signal $D_{a3}$ enters an input circuit 2, no signal enters AND circuits $A_1$ to $A_8$ from the input circuit 2 (AND circuits $A_4$, $A_5$, $A_6$ and $A_7$ are omitted from the drawing for the purpose of simplification), whereby the AND circuits $A_1$ to $A_8$ become inoperative and transistors $T_{r1}$ to $T_{r8}$ are turned off (transistors $T_{r4}$, $T_{r5}$, $T_{r6}$ and $T_{r7}$ are omitted from the drawing for the same purpose). As a result, AND circuits $A_{11}$ to $A_{18}$ are ready to be operated (AND circuits $A_{14}$, $A_{15}$, $A_{16}$ and $A_{17}$ are omitted from the drawing for the same purpose).

On the other hand, the output circuit 4 allows signals corresponding to the display devices $L_1$ to $L_8$ represented by display signal $D_3$ to enter the AND circuits $A_{11}$ to $A_{18}$ and a time dividing multiplexer 8, while allowing other signals corresponding to the display devices $L_9$ to $L_{15}$ to enter another circuit which is not shown in the drawing a display circuit for allowing the display devices $L_9$ to $L_{15}$ to be lighted is omitted from FIG. 9).

Assuming that the signals corresponding to the display devices $L_1$ to $L_8$ are identified by signal $d_1$ to $d_8$, the signals $d_1$, $d_2$, $d_4$, $d_5$, $d_7$ and $d_8$ are represented by "1", while the signals $d_3$ and $d_6$ are represented by "0". Thus, the AND circuits $A_{11}$, $A_{12}$, $A_{14}$, $A_{17}$ and $A_{18}$ become operative but the AND circuits $A_{13}$ and $A_{16}$ become inoperative.

Figure 10:
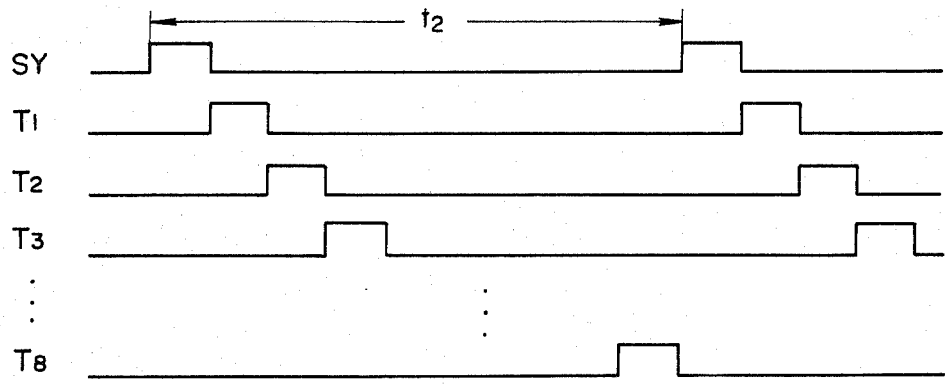
FIG. 10 is a typical time chart representing a timing signal SY and other timing signals $T_1$ to $T_8$.

The time dividing multiplexer 8 is constructed such that as, timing signals $T_1$ to $T_8$ enter there (timing signals $T_4$, $T_5$, $T_6$ and $T_7$ are omitted from FIG. 10), the signals $d_1$ to $d_8$ enter a counter 10 as well as a gate circuit 13 one after another. The counter 10 serves to add a count value $C_a$ to a BCD converting circuit 11. Then, the count value $C_a$ is converted into a BCD code signal $C_d$ in the BCD converting circuit 11 and the latter enters a segment driving circuit 12. The segment driving circuit 12 generates signals $S_1$ to $S_7$ (signals $S_4$, $S_5$ and $S_6$ are omitted from the drawing) for displaying the numeral corresponding to the entered BCD code signal $C_d$ on the display devices $L_1$ to $L_8$ and then the thus generated signals enter the gate circuit. When the time dividing multiplexer 8 issues an output signal "1", the gate circuit 13 allows the entered signals $S_1$ to $S_7$ to enter the display devices $L_1$ to $L_8$. Since the display devices $L_1$ to $L_8$ are connected in parallel, the signals $S_1$ to $S_7$ enter the display devices $L_1$ to $L_8$ simultaneously.

On the other hand, as the time dividing multi-circuit 9 receives the timing signals $T_1$ to $T_8$, the signals $d_1$ to $d_8$ enter transistors $T_{r11}$ to $T_{r18}$ (transistors $T_{r14}$, $T_{r15}$ and $T_{r16}$ are omitted from the drawing), respectively. Thus, when the signals $d_1$ to $d_8$ are identified by "1", the transistors $T_{r11}$ to $T_{r18}$ are turned on.

Thus, as the signals $T_1$ to $T_8$ enter the corresponding time dividing multiplexers 8 and 9, the display devices $L_1$, $L_2$, $L_4$, $L_5$, $L_7$ and $L_8$ are caused to display the numerals 1, 2, 3, 4, 5 and 6 in accordance with the above numeral order, whereas no display is activated by the display devices $L_3$ and $L_6$.

When the timing signal SY (see FIG. 10) enters a reset input R of the counter 10, the latter is reset.

The above-described displays are repeated at a frequency $t_2$. This frequency $t_2$ is determined such that no fluctuation occurs in display operation of the respective display devices $L_1$ to $L_8$.

If misfeeding takes place at the second work station for some reason, a signal $D_{a3}$ enters the input circuit 2. This causes the AND circuit $A_2$ to become operative whereby an operation is initiated at a frequency $t_1$ at which the pulse generator 7 generates an output pulse $P_o$ (see FIG. 11). As a result, the transistor $T_{r2}$ is turned on at a frequency $t_1$. Thus, the AND circuit $A_{12}$ is inhibited at the frequency $t_1$ and the transistor $T_{r12}$ is turned off at the frequency $t_1$. The display device $L_2$ fails to activate any display while the transistor $T_{r12}$ is turned off at the frequency $t_1$. The result is that the numeral 2 is displayed by intermittent lighting of the display device $L_2$.

Figure 11:
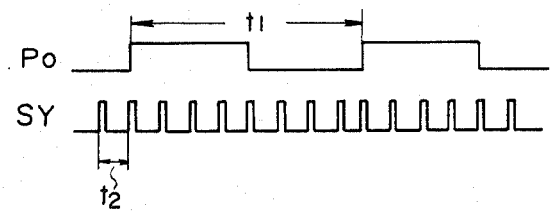
FIG. 11 is a typical time chart illustrating a relation between a period $t_1$ of a signal $P_o$ and a period $t_2$ of the signal SY.

As is readily apparent from FIG. 11 the period $t_1$ of the output pulse $P_o$ generated by the pulse generator 7 is substantially longer than the period $t_2$ of the timing signal SY. (It should be noted that the timing signals SY and $T_1$ to $T_8$ are issued from a control circuit which is not shown in the drawing.)

What I claim is:

1. A misfeed monitoring apparatus for a transfer press of a type in which feeder stroke is changeable, comprising:

display means for providing a work station display at each of a plurality of display positions, the number of display positions equalling the number of said work stations, which number changes as the feeder stroke changes; and flickering means for flickering the display of any work stations at which misfeeding takes place.

2. A misfeed monitoring apparatus as defined in claim 1, wherein said work station display is a numerical display indicating operation order of said work stations.

3. A misfeed monitoring apparatus as defined in claim 1, wherein said display means comprises:

a memory circuit for storing the number of said display positions and the operation order of said work stations corresponding to a predetermined feeder stroke, taking the feeder stroke as an address of the memory circuit; and a display circuit for performing flickering display in response to the output of said memory circuit when a misfeed occurs.

* * * * *